US007377420B2

(12) United States Patent
Gardner

(10) Patent No.: US 7,377,420 B2
(45) Date of Patent: May 27, 2008

(54) TWO PIECE BLISS BOX WITH SLOPED BOTTOM

(75) Inventor: Jeffrey M. Gardner, West Chicago, IL (US)

(73) Assignee: Weyerhaeuser Company, Federal Way, WA (US)

( * ) Notice: Subject to any disclaimer, the term of this patent is extended or adjusted under 35 U.S.C. 154(b) by 0 days.

(21) Appl. No.: 11/396,165

(22) Filed: Mar. 31, 2006

(65) Prior Publication Data

US 2007/0228127 A1 Oct. 4, 2007

(51) Int. Cl.
*B65D 5/32* (2006.01)
*B65D 5/56* (2006.01)
*B65D 5/74* (2006.01)

(52) U.S. Cl. ..... 229/122.23; 229/117.3; 229/122.1; 229/122.34

(58) Field of Classification Search ..... 229/122.1, 229/122.23, 122.26, 117.3, 122.34; 206/762, 206/765
See application file for complete search history.

(56) References Cited

U.S. PATENT DOCUMENTS 248,143 A * 10/1881 Cooke ..... 229/122.23
1,000,624 A * 8/1911 Pexton ..... 229/122.1
2,770,409 A * 11/1956 Moore ..... 229/122.23
3,081,003 A * 3/1963 Baxter et al. ..... 222/105
3,170,617 A * 2/1965 Vineberg ..... 229/122.23
3,184,140 A * 5/1965 Peterson ..... 229/122.23
3,831,834 A * 8/1974 Elward ..... 229/122.23
4,275,828 A * 6/1981 De Franco ..... 229/122.23
4,673,125 A * 6/1987 Weaver ..... 222/105
4,805,765 A * 2/1989 Barrett et al. ..... 229/122.1
5,328,082 A * 7/1994 Fritz et al. ..... 229/122.1
6,554,159 B1 * 4/2003 Behr et al. ..... 221/305

* cited by examiner

*Primary Examiner*—Gary E Elkins

(57) ABSTRACT

A two-piece bliss-type container blank and resulting container for easily dispensing products contained within is disclosed. Specifically, the container is designed to have an exterior bottom panel that is essentially flat, while having an internal bottom panel that is inclined toward a front panel. The front panel includes structure to permit the removal of product from within the container. The two-piece bliss-type structure provides a strong and stable container that may be constructed to varying sizes and geometries.

4 Claims, 6 Drawing Sheets

TWO PIECE BLISS BOX WITH SLOPED BOTTOM

FIELD OF THE INVENTION

This invention relates generally to bliss-type container blanks and containers. More specifically, the present invention relates to a two-piece bliss container having sloped interior bottom wall.

BRIEF DESCRIPTION OF THE DRAWINGS

The invention is best understood from the following detailed description when read in connection with accompanying drawings. It is emphasized that, according to common practice, various features of the drawings are not to scale. On the contrary, the dimensions of various features are arbitrarily expanded or reduced for clarity. Included in these drawings are the following figures.

DETAILED DESCRIPTION

Figure 1:
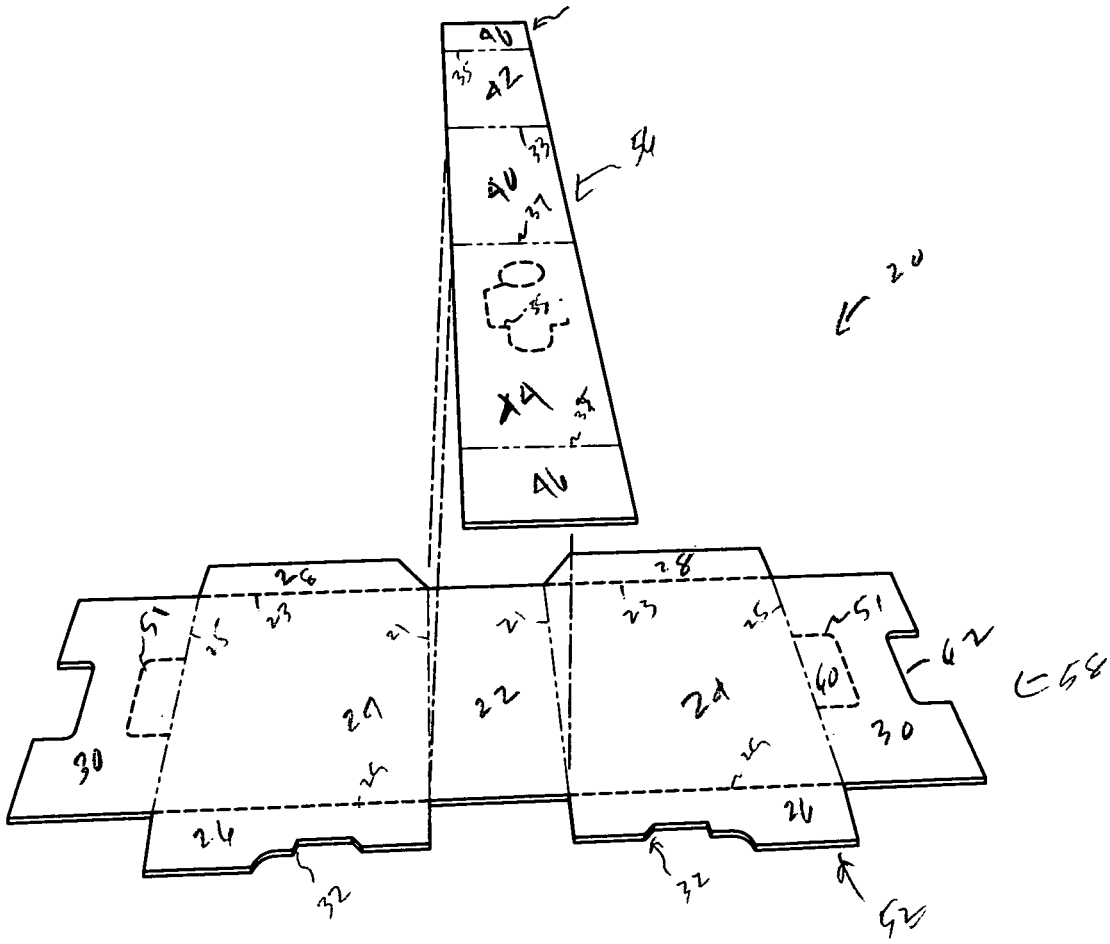
FIG. 1 is an exploded perspective view of an exemplary two-piece bliss box blank arrangement.

The present invention will now be described with reference to the accompanying drawings. The present invention is directed to a two-piece bliss type container blank 20. The two piece blanks includes a liner blank 56 and a body wrap blank 58 which when combined form container 54. The two-piece bliss type box arrangement is convenient for imparting strength and stability while allowing the container 54 to carry and easily dispense liquid or other flowable products. One suitable embodiment of the container blank arrangement 20 and resulting container 54 is described in more particularity below.

FIG. 1 depicts a blank 20 used to form a container 54. The blank 20 is typically constructed from a single piece of formable material such as, without limitation, sheets of cellulose-based material formed from cellulose materials such as wood pulp, straw, cotton, bagasse, or the like. Cellulose-based materials used in the present invention may come in many forms, such as fiberboard, containerboard, corrugated containerboard and paperboard. However, it will be appreciated that the single piece of formable material may be constructed from other material as well, such as, without limitation, a polymer based material. The polymer based material may be in the form of a sheet of plastic material, or a sheet of corrugated plastic material.

The blank 20 is cut and scored, perforated or otherwise formed into a plurality of panels that, when assembled, form container 54. In all FIGURES, like numbers indicate like parts; additionally, cut lines are shown as solid lines, score lines as dashed lines, and lines of perforation as broken lines. For the purposes of further description herein, the downward direction is defined as a direction perpendicular to the first bottom panel 22 when the container 54 has been erected. The upwards direction is defined as the direction perpendicular to the first bottom panel 22 that corresponds to the inner surface of the bottom panel when the container 54 has been erected.

With respect to FIG. 1, the container blank arrangement 20 includes a two-piece blank arrangement. Specifically, the container blank arrangement 20 includes the liner blank 56 and the body wrap blank 58. The liner blank 56 and the body wrap blank 58 are configured such that when the various panels are folded as described in more detail below the container 54 is formed.

The liner blank 56 includes a second bottom panel 40. Attached to the second bottom panel 40 is a rear panel 42 attached to the second bottom panel 40 along a fold line 33. Opposite fold line 33 is a fold line 37, and attached to the second bottom panel 40 along the fold line 37 is a front panel 44. Both the back panel 42 and the front panel 44 include a top flap 46 that are connected to the back panel 42 and front panel 44 along fold lines 35 respectively. Formed in the front panel 44 is a valve assembly punch-out panel 38.

The body wrap blank 58 includes a first bottom panel 22. Additionally opposed side panels 24 are connected to the first bottom panel 22 along fold lines 21. Opposite the first bottom panel 22 are top panels 30 that are connected to the side panels 24 along fold lines 25. Additionally, each side panel 24 is attached to a front flap 26 along a fold line 29. Also the side panel 24 is connected with a rear flap 28 along a fold line 23, opposite fold line 29.

The top panels 30 include a hand-hold punch-out panel 60 and hand-hold cut-out 62 formed therein. The hand-hold punch-out panel 60 is defined by perforation line 51. The hand-hold cut-out 62 is generally defined in the outer periphery of the top panel 30. It will be appreciated that the relative size, shape, and location of the hand-hold punch-out panel 60 and hand-hold cut-out 62 will be such that when the container 54 is formed, the hand-hold punch-out panel 60 and hand-hold cut-out 62 align to provide a sturdy hand-hold for the container 54.

Each respective front flap 26 includes a portion of a valve mechanism profile cut-out 32 formed there within. It will be appreciated that at least a portion of the valve mechanism profile 32 formed in the front flap 26 is representative of the valve mechanism punch-out formed within the front panel 44. It will further be appreciated that the illustrated valve mechanism profile cut-out 32 formed in the front flaps 26 and the valve assembly punch-out panel 38 are merely illustrative of one possible configuration, and are not intended to limit the scope of the present invention. The intent is merely to show where access to an interior of the formed container 54 may be provided, and one possible manner in which this may be accomplished. Those skilled in the art will appreciate that many other configurations for providing access are within the scope of this invention.

Figure 2:
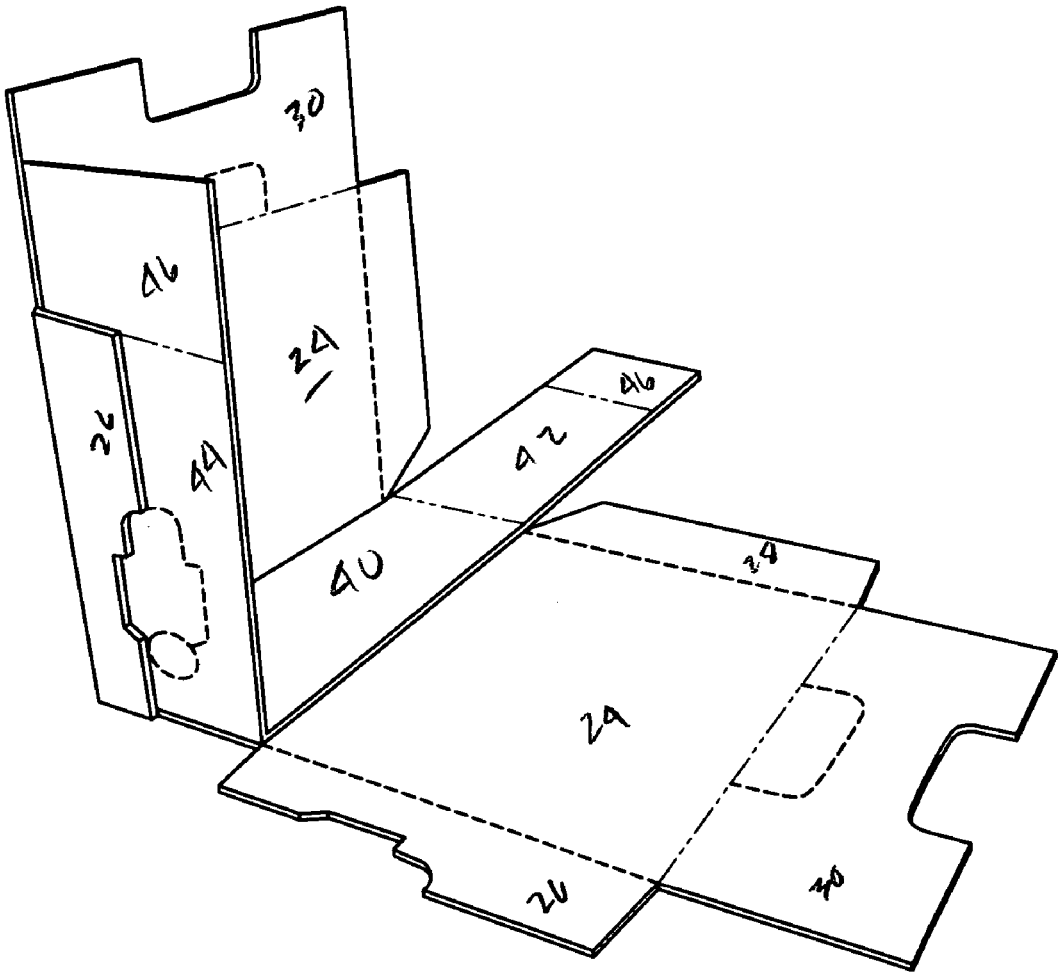
FIG. 2 is an exemplary partially erected view of the two-piece bliss box blank arrangement of FIG. 1.
Figure 6:
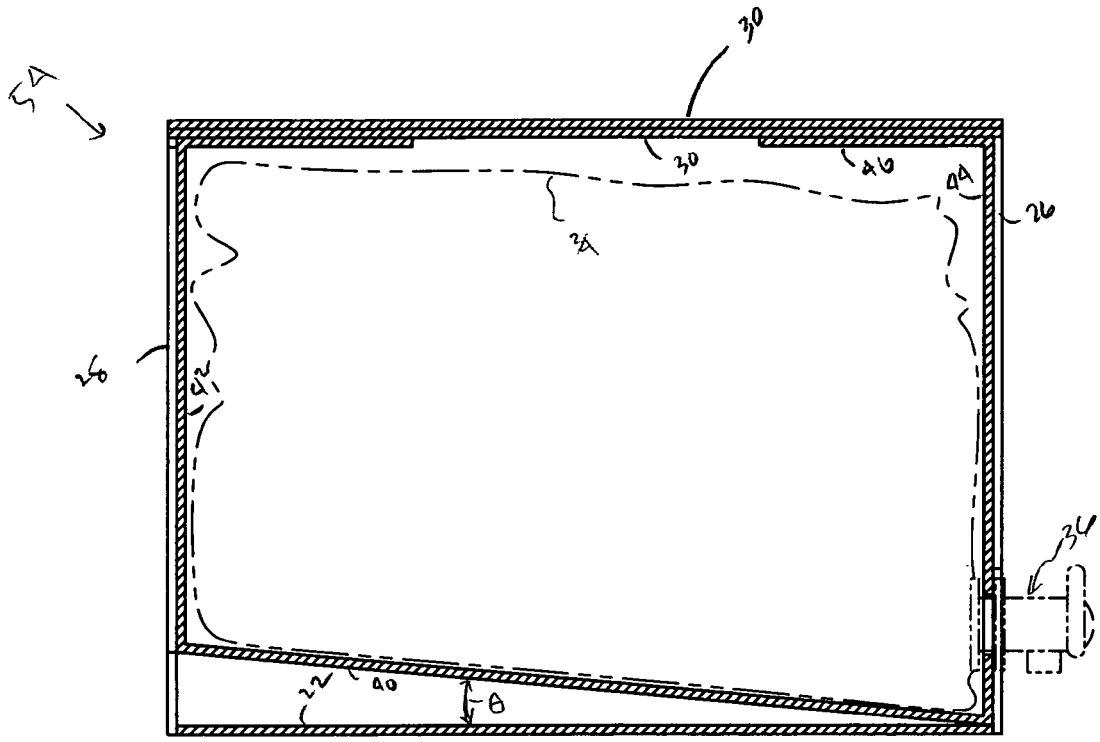

With respect to FIG. 2, erection of the two-piece bliss container 54 will now be described herein. Specifically, the liner blank 56 is laid juxtaposed the body wrap blank 58 such that the second bottom panel 40 overlays the first bottom panel 22. As can be seen in FIG. 2 and FIG. 6, the length of the second bottom panel 40 measured in a direction from fold line 37 to fold line 33 is greater than the length of the first bottom panel measured in a direction from fold line 29 to fold line 23. Those skilled in the art will appreciate that the increased length of the second bottom panel 40 is an example of how the slope that the second bottom panel 40 has relative to the first bottom panel 22 when the container 54 is formed is determined. The angle of that slope is a question of design choice that may be based upon the type of product in the container and/or the location of the valve mechanism cut-outs. However, it will be appreciated that the overall length of the second bottom panel with respect to the first bottom panel should be sufficient to provide enough slope to allow the easy dispersal of any products (not shown) herein. It is believed that the second bottom panel 40 relative to the first bottom panel 22 may be at an angle of about 5 degrees to about 40 degrees. However, the degree of angle between these two panels may be less than or greater than this disclosed range.

Figure 3:
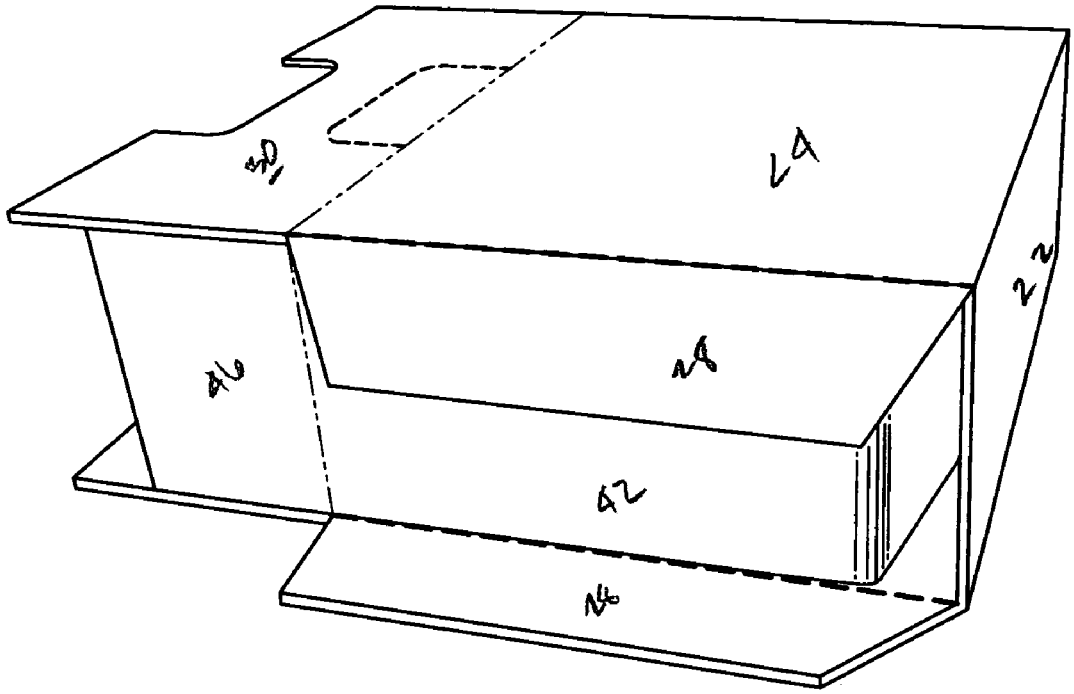
FIG. 3 is another perspective view of the partially erected two-piece bliss box blank arrangement of FIG. 1.
Figure 4:
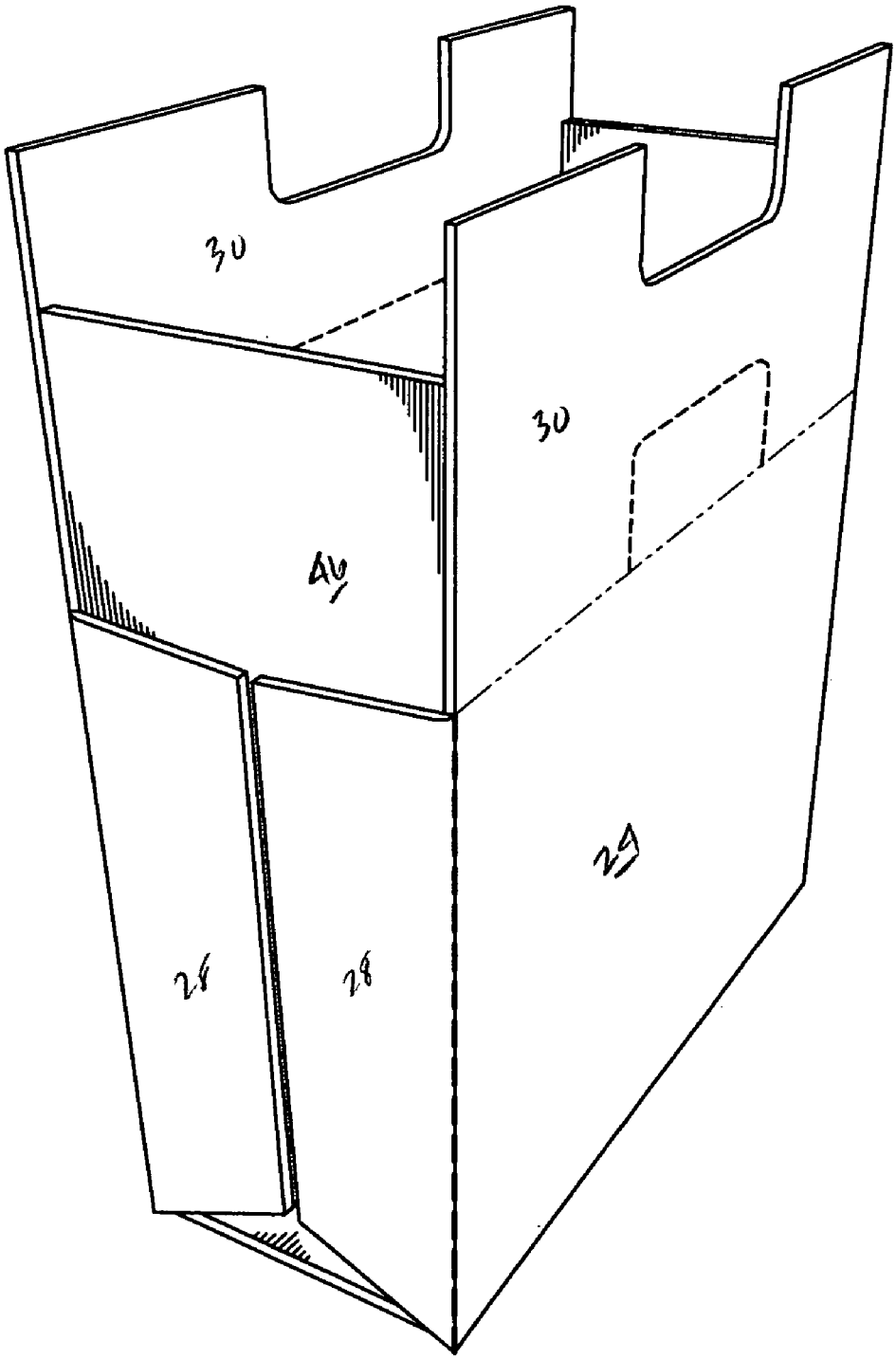
FIG. 4 is yet another perspective view of the partially erected two-piece bliss box blank arrangement of FIG. 1.

Further erection of the container is caused by folding the front panel 44 upwardly approximately 90 degrees along the fold line 37. Subsequently the front flaps 26 may be folded inwardly approximately 90 degrees along fold line 29 such that the front flap 26 and front panel 44 are juxtaposed to one another. Additionally the rear panel 42 may be folded upwardly along a fold line 33 approximately 90 degrees. Subsequently the rear flaps 28 may be folded inwardly along fold lines 23. Consequently, the rear flap 28 and the rear panel 42 will be in juxtaposition relative to one another. At this point, as best seen in FIGS. 3 and 4, the container 54 is now ready to receive product (not shown) there within.

Figure 5:
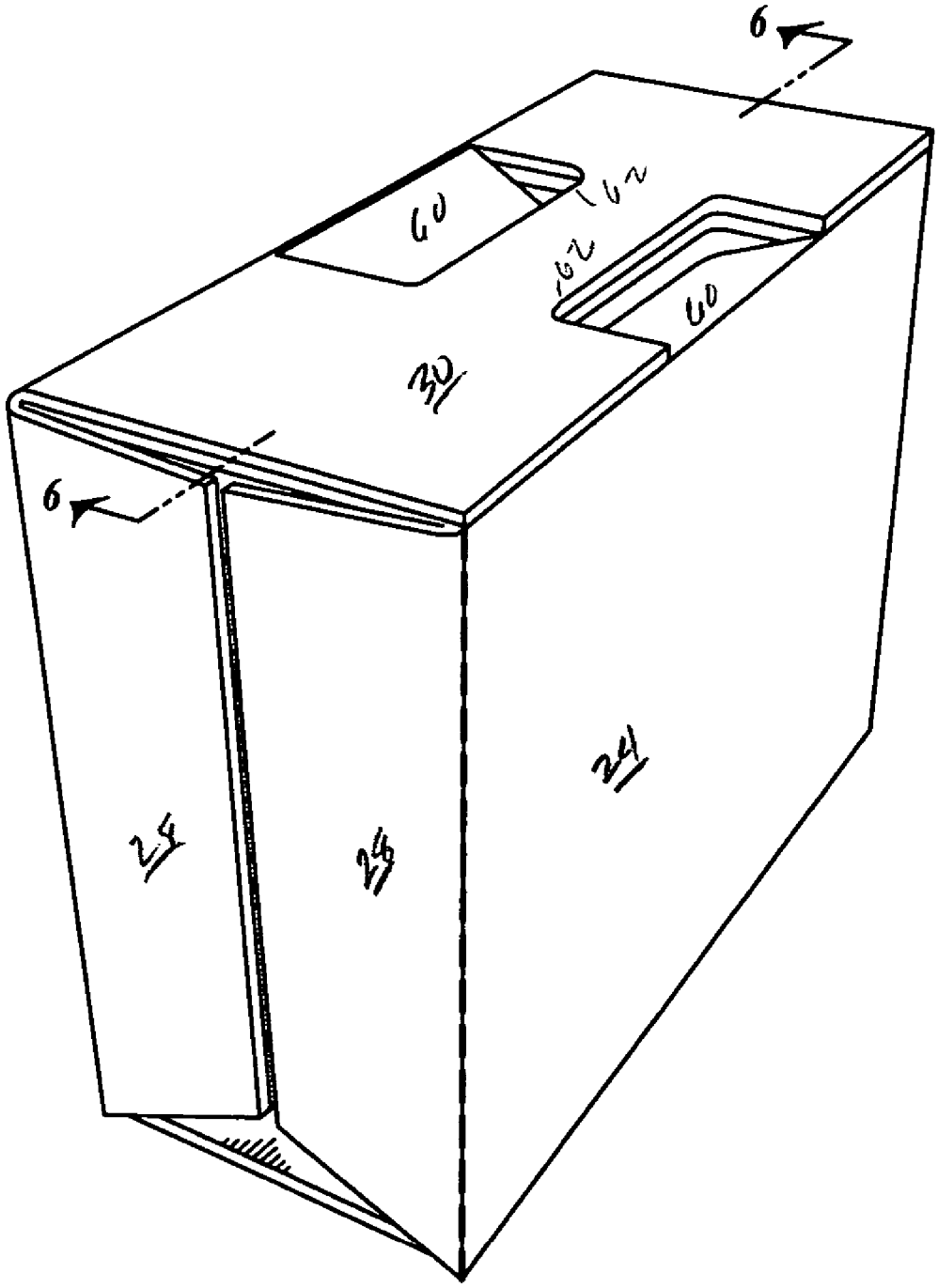
FIG. 5 is an exemplary rear perspective view of the formed two-piece bliss container; and, FIG. 6 is a side sectional view of the container depicted in FIG. 5 along cut line 6-6 shown in FIG. 5.

Once the product (not shown) is placed within the container 54, the top assemblies may be closed. Specifically, the top flaps 46 are folded inwardly approximately 90 degrees along fold lines 35. Subsequently the top panels 30 may be folded inwardly approximately 90 degrees along a fold line 25. As best seen in FIG. 5, the hand-hold punch-out panels 60 may then be pressed downwardly, thereby allowing a user to grasp the area between the two hand-hold cut-outs 62.

As best seen in FIG. 6, the two-piece bliss box container includes a sloped inner bottom panel while still keeping a flat outer bottom panel. As mentioned above, in one embodiment the amount of slope between the second bottom panel 40 and the first bottom panel 22 maybe a function of their respective lengths. As discussed above, the angle between the second bottom panel 40 and the first bottom panel 22 is variable, and is determined at least partially by the nature of the product within the container 54.

One possible type of product that my suitably be used with this container 54 is a liquid product, such as bagged wine, or dairy products. To this end, the container 54 may be used to hold a bag 34 with a valve mechanism 36. The bag 34 may be any suitable liquid impermeable bag suitable for holding a variety of liquids. Additionally, the bag may include the valve assembly 36 that is configured to operatively allow any products contained within the bag to be selectively released.

As noted above, the overall geometry of the various panels is not to be limited by the FIGURES. Specifically, the front panel 44 and rear panel 42 are depicted as being rectangular; however, the both panels may be any other geometric shape is without exceeding the spirit and scope of the present invention. For example, without limitation, the front panel 44 and rear panel 42 may be square. Likewise, the first bottom panel 22 and the second bottom panels 40 may wider or narrower as the need arises. It will be appreciated that the geometry of the various panels may be adjusted accordingly without exceeding the spirit and scope of the present invention.

While various embodiments of the invention have been illustrated and described, as noted above, many changes can be made without departing from the spirit and scope of the invention. Accordingly, the scope of the invention is not limited by the disclosure of such embodiments. Instead, the invention should be determined entirely by reference to the claims that follow.

What is claimed is:

1. A two piece Bliss style container formed from two separate blanks of foldable material, the container comprising:

a first blank having a first inner bottom panel having opposed sides;

an inner front panel attached to the first bottom panel at one of the opposed sides, the front panel including a substantially centrally located cut-out configured to receive a valve assembly;

an inner rear panel attached to the first bottom panel at the other opposed side;

a second blank having a second outer bottom panel having opposed sides;

an outer side panel attached to the outer second bottom panel at one of the opposed sides;

an outer front flap attached to the outer side panel, the outer front flap being adjacent the inner front panel; and an outer rear flap attached to the outer side panel, opposite the outer front flap, the outer rear flap being adjacent the inner rear panel;

an outer top panel connected with the outer side panel opposite the second outer bottom panel, the outer top panel including at least a portion of a handhold cut-out formed therein;

wherein the two-piece Bliss style container is configured such that the first bottom panel and the second bottom panel are inclined relative to one another, with an intersection point at about the intersection of the first inner bottom panel with the inner front panel.

2. The container of claim 1, wherein the foldable material is formed from a cellulose-based material.

3. The container of claim 2, wherein the cellulose based material is formed from at least one of a wood pulp, straw, cotton, and bagasse.

4. The container of claim 2, wherein the cellulose based material is in the form of at least one of a fiberboard, containerboard, corrugated containerboard and paperboard.

* * * * *